US007806062B2

(12) United States Patent
Klapp et al.

(10) Patent No.: US 7,806,062 B2
(45) Date of Patent: Oct. 5, 2010

(54) SEWING MACHINE AND SEWING ELEMENT

(75) Inventors: Hartmut Klapp, Kaarst (DE); Dirk Küster, Mönchengladbach (DE); Klaus Stutznäcker, Frechen (DE)

(73) Assignee: Nahmaschinenfabrik Emil Stutznacker GmbH & Co KG, Koln (DE)

( * ) Notice: Subject to any disclaimer, the term of this patent is extended or adjusted under 35 U.S.C. 154(b) by 435 days.

(21) Appl. No.: 11/659,984

(22) PCT Filed: Aug. 9, 2005

(86) PCT No.: PCT/EP2005/008604

§ 371 (c)(1),
(2), (4) Date: May 12, 2008

(87) PCT Pub. No.: WO2006/018177

PCT Pub. Date: Feb. 23, 2006

(65) Prior Publication Data

US 2008/0271658 A1 Nov. 6, 2008

(30) Foreign Application Priority Data

Aug. 12, 2004 (DE) ..... 10 2004 039 361

(51) Int. Cl.
*D05B 1/10* (2006.01)
*D05B 61/00* (2006.01)

(52) U.S. Cl. ..... 112/197; 112/187

(58) Field of Classification Search ..... 112/222, 112/224–227, 187, 261, 197–202
See application file for complete search history.

(56) References Cited

U.S. PATENT DOCUMENTS

| | | | | |
|---|---|---|---|---|
| 2,989,017 | A * | 6/1961 | Taketomi | 112/187 |
| 3,753,410 | A | 8/1973 | Kostenowczyk | |
| 3,986,468 | A * | 10/1976 | Szostak et al. | 112/222 |
| 4,480,562 | A | 11/1984 | von Hagen et al. | |
| 4,858,543 | A * | 8/1989 | Badillo | 112/231 |
| 4,942,834 | A | 7/1990 | Kitai | |
| 4,974,534 | A * | 12/1990 | Eberhahn et al. | 112/199 |
| 5,383,414 | A | 1/1995 | Winter et al. | |
| 5,769,018 | A * | 6/1998 | Nakano | 112/475.17 |
| 5,901,655 | A * | 5/1999 | Sadasue | 112/162 |
| 2001/0037754 | A1 | 11/2001 | Tanaka | |

FOREIGN PATENT DOCUMENTS

| | | |
|---|---|---|
| DE | 32 01 254 A1 | 7/1993 |
| DE | 43 20 956 A1 | 1/1995 |

* cited by examiner

*Primary Examiner*—Ismael Izaguirre
(74) *Attorney, Agent, or Firm*—Jones & Smith, LLP; John Wilson Jones

(57) ABSTRACT

A chain stitch or a double chain stitch sewing machine or sewing element of a sewing machine comprising three elements: a needle; a looper; and a spreader improved in such a way that a collision of any two of the elements during the sewing operations will not cause serious damage to the sewing machine and stop periods as a consequence thereof. It is provided that the sewing elements are formed such that at least one sewing element, in particular the spreader, will dodge or break at the predetermined breaking point due to its design and/or material properties.

31 Claims, 5 Drawing Sheets

SEWING MACHINE AND SEWING ELEMENT

Figure 1:
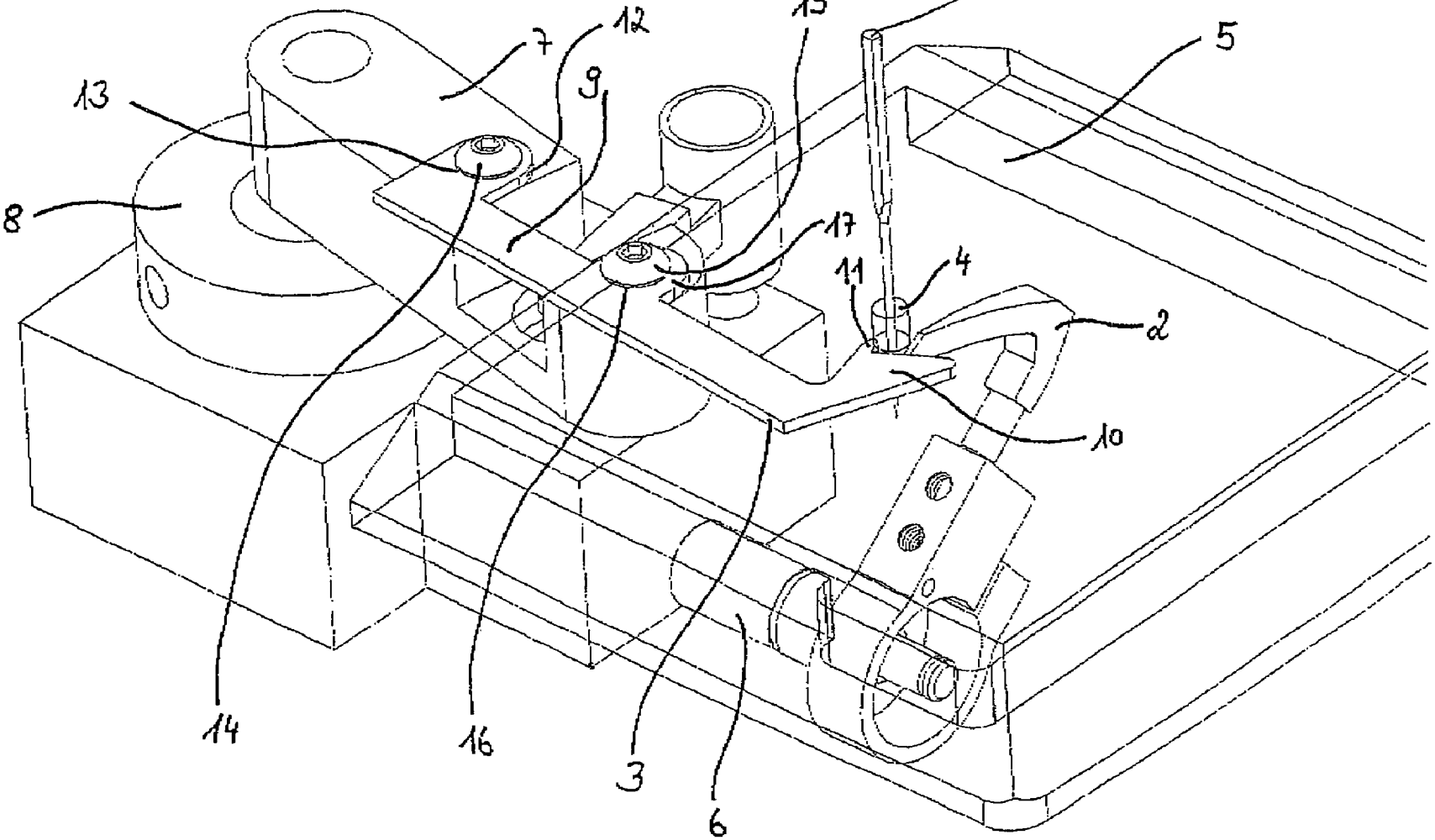

This invention relates to a sewing machine, especially a chain stitch or a double chain stitch sewing machine and preferably a multiple needle chain stitch or a multiple needle double chain stitch sewing machine employing three stitch forming sewing elements, namely a needle, a looper, and a spreader, which spreader spreads a thread triangle of a looper thread in which the needle carrying a needle thread is inserted for the connection of the needle thread to the looper thread, and which sewing elements are driven through at least one driving means. The invention further relates to a sewing element for a sewing machine, especially a chain stitch or a double chain stitch sewing machine, preferably a multiple needle chain stitch or a multiple needle double chain stitch sewing machine, said element consisting of a spreader that spreads a thread triangle of a looper thread in which a needle carrying a needle thread is inserted for the connection of the needle thread to the looper thread.

Sewing machines and sewing elements of the type as described are known from prior art. The document U.S. Pat. No. 5,154,130 for instance discloses a multiple needle chain stitch sewing machine employing three stitch forming sewing elements which are formed as a needle, a looper, or a spreader. The needle is arranged above a fabric support and is reciprocated up and down, and said needle has on its free end that plunges into the fabric a needle eye carrying a needle thread. Below the fabric support an oscillating driven looper is provided which comprises on its free end an opening with a looper thread passing there through that is connected to the needle thread during the sewing operation. The multiple needle chain stitch sewing machine which is pre-known from the document U.S. Pat. No. 5,154,130 performs chain stitches. During this operation, the looper oscillates to and fro below the fabric support, whereas this oscillating movement is effected parallel to the direction of the stitched seam. By means of a spreader which is also arranged below the fabric support the forming of a thread triangle is securely and reliably effected. The needle carrying the needle thread plunges in this thread triangle.

Normally two spreader movements are possible. On one hand the spreader can be moved in a moving direction. However, in a sewing machine that is pre-known from the document U.S. Pat. No. 5,154,130 the spreader moves on an orbit or an elliptical orbit whereas the spreader traverses or crosses a stitch hole during its movement which is arranged in the fabric support and into which the needle plunges.

The sewing elements are driven by at least one driving means, and provisions have to be made for the flow of the movements of the three sewing elements being controlled in such a way that the three sewing elements do not collide. Independently of the driving means a collision cannot axiomatically be excluded. If the sewing elements collide with each other, which happens especially between the spreader and the needle, since the spreader traverses or crosses the stitch hole in the fabric support, there is a considerable risk that the sewing elements or other components connected to them will be damaged or even destroyed. Such damage or destruction usually leads to a stop of the entire sewing machine and to costly reconditioning work.

In view of this prior art it is an object of the present invention to improve a sewing machine of the above-described type or a sewing element of the above-described type in such a way that a collision between the sewing elements of the sewing machine will not cause serious damages to the sewing machine and therewith associated extended stop periods of the sewing machine.

In a sewing machine of the above-described type the solution of this object provides that the sewing elements are formed in such a way that at least one sewing element, particularly the spreader, will dodge or break at a predetermined breaking point when it collides with a second sewing element, particularly the needle, due to its design and/or its material properties. For the solution of this object in a sewing element of the type as described above it is provided in the same way that in the case of a collision of the spreader with a second sewing element, particularly the needle, the spreader will dodge or break at a predetermined breaking point, due to its design and/or its material properties.

For this reason basically two embodiments are provided for the solution of the object of the invention. According to the first embodiment it is provided that the sewing elements are formed such that in the case of a collision of the sewing elements at least one of the sewing elements is able to dodge, due to its design and/or its material properties and especially due to its elasticity. Due to the fact that at least one sewing element, normally the spreader, will dodge it is possible to almost completely prevent damage to the sewing elements and to construction components connected to them.

As an alternative it may be provided that the sewing elements are formed such that at least one of the sewing elements will break at a predetermined breaking point, whereas in this case for example it is also the spreader and possibly also the needle which are suitable. If one of the sewing elements breaks at a predetermined breaking point, the damage of a collision of two sewing elements will be limited to a quick and easy replacement of the damaged or destroyed sewing element, while further damage to other construction components of the sewing machine will not have to be feared.

According to a further feature of the invention it is provided that the sewing elements are driven through separate driving means, with said driving means being interconnected through an electronic control. This construction may do without a mechanical coupling of the driving shafts of the three sewing elements, provided that the adjustments for perfect running including the related movements of the sewing elements are effected through the electronic control.

Preferably, the spreader is guided on a closed orbit, particularly on a circular or elliptical orbit.

According to a further feature of the invention it is provided that the spreader is mounted in a carrier in such a way that the carrier will release the spreader when a predetermined arising force is reached that occurs in the case of a collision with the needle and/or the looper. In this respect a two-point support in the carrier turned out as appropriate, with one supporting point opening or breaking when said predetermined force is reached, so that the spreader will be free pivotable about the second supporting point.

An advantageous further development of this embodiment provides that when the predetermined force is reached the spreader pivots against a spring that pushes the spreader back to its initial position as soon as the spring force exceeds the predetermined force. Consequently, in the case of a collision the spreader is moved out of its carrier against a spring that is formed for instance as a pressure spring which is stretched by the switching of the spreader. As soon as the force caused by the collision is reduced said spring is able push the spreader back to its initial position, so that the sewing operation can be continued. But normally adjustment work will become necessary concerning the sequence of movements of the three sewing elements. In this respect it may be provided for instance that a signal is generated at the occurrence of the predetermined force, which signal indicates to the operator of the sewing machine that an adjustment operation is required.

Important is that during the sewing operation the sewing elements or other construction components will not be damaged or destroyed even if they collide.

An alternative embodiment provides that the spreader at least in the region of its free end spreading the thread triangle has an elasticity which makes it possible for the spreader to dodge upon contacting the needle. Accordingly, when the spreader contacts the needle the elasticity of the spreader will permit the spreader to dodge, so that the pressure which is produced during the collision of the two sewing elements will lead to a deformation of the spreader. Due to its elasticity the spreader can return to its staring form, so that neither in this case any damage is caused to the spreader or to the needle.

The elasticity of the spreader can be determined by its shape and/or its material. For instance, the spreader may be formed at least in the region of its free end as a wire with a circular or rectangular and particularly a square cross section.

An advantageous further development of this embodiment provides that in the region of its free end the spreader is supported on one side. This support has the advantage that in the case of a collision only a short part of the free end will dodge. Besides, this will lead to the fact that possible vibrations of the spreader during the sewing operation are reduced. Here it turned out as advantageous to support the spreader resiliently against a limit stop, so that vibrations are damped due to the biasing of the spreader.

According to a further feature of the invention the supporting is effected with respect to the carrier.

According to a further feature of the invention it is provided that the spreader consists of a material with a high elastic modulus, particularly of spring steel or of a plastic material.

Furthermore, it turned out as advantageous that the spreader comprises inclined surfaces which are arranged in the region of the possible contact area with the needle and which are oriented to the needle. Normally a collision between the spreader and the needle takes place when the spreader traverses or crosses the stitch hole while the needle is in its plunged position. But in a few cases of exception the possibility exists that the needle while being plunged in the stitch hole collides with the spreader that is just traversing or crossing the stitch hole. For this purpose the inclined surfaces are provided which deflect the needle towards one side of the spreader, so that the needle will pass in this deflected condition. Preferably, the surface here concerned is the surface of the spreader which is the trailing surface if viewed in the moving direction. The inclined surfaces are formed for instance by a preferably triangular cross section of the spreader in the possible contact area. But it is also possible to arrange a bevel in this area which necessarily deflects the needle to the trailing part of the spreader.

Finally, in a sewing machine according to the present invention it is provided that in a multiple needle sewing machine several spreaders are arranged on a support plate and that each of these spreaders has a predetermined breaking point.

The above-described advantages of the sewing machine according to the invention are also valid for the sewing element according to the invention.

Further features and advantages of the invention will become apparent from the following description of the attached drawing showing preferred embodiments of a sewing machine according to the invention.

Figure 2:
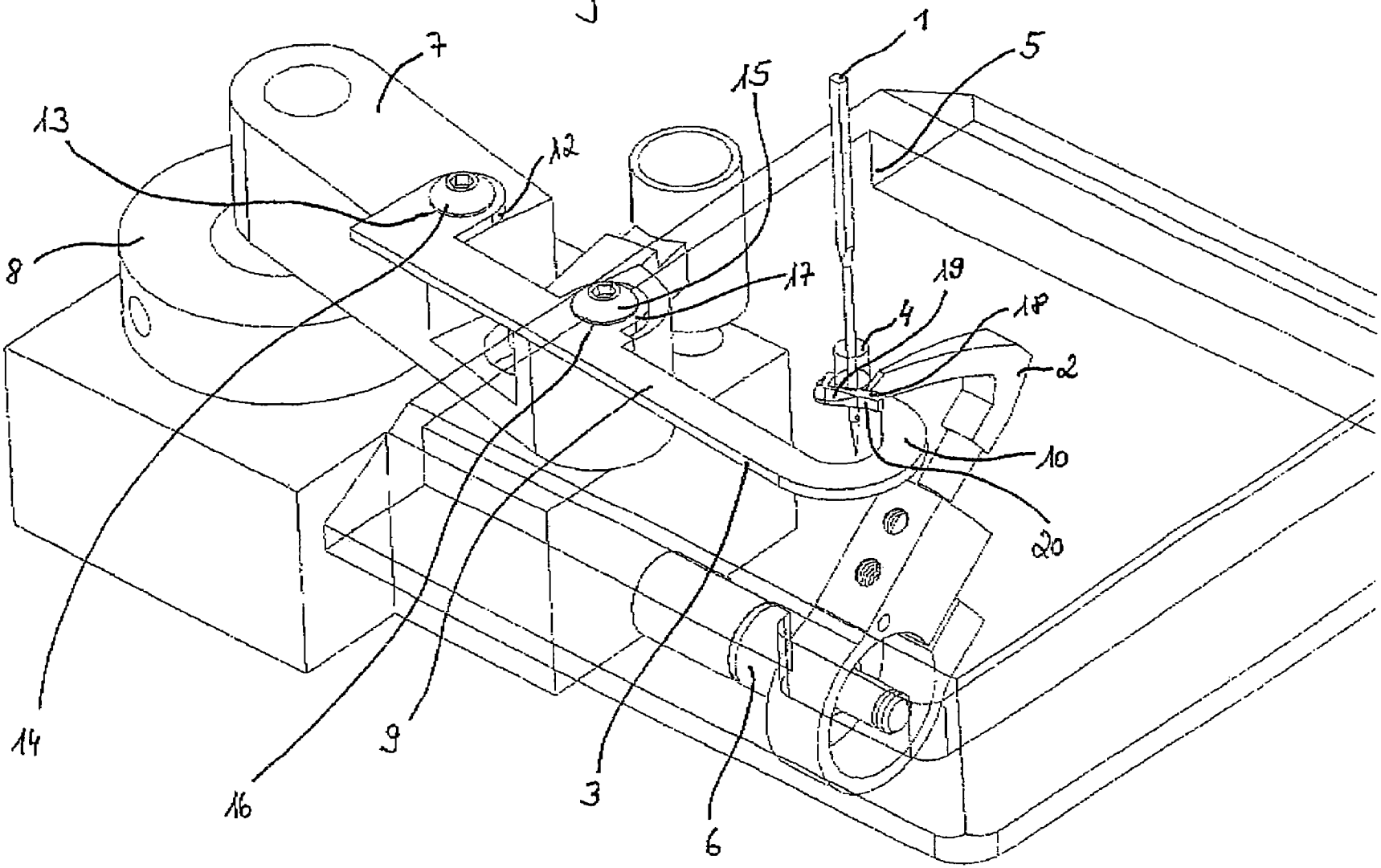
Figure 3:
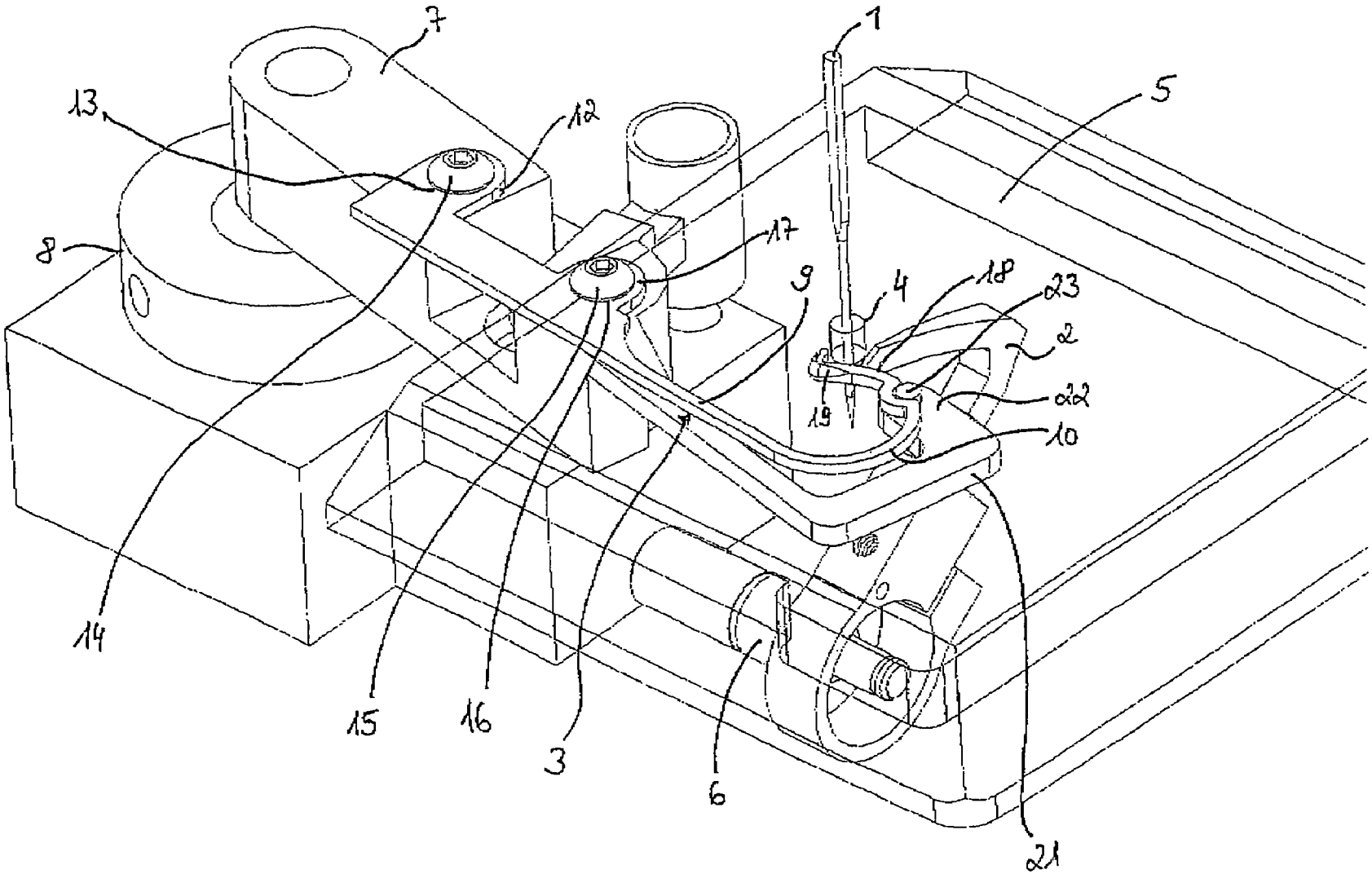
Figure 4:
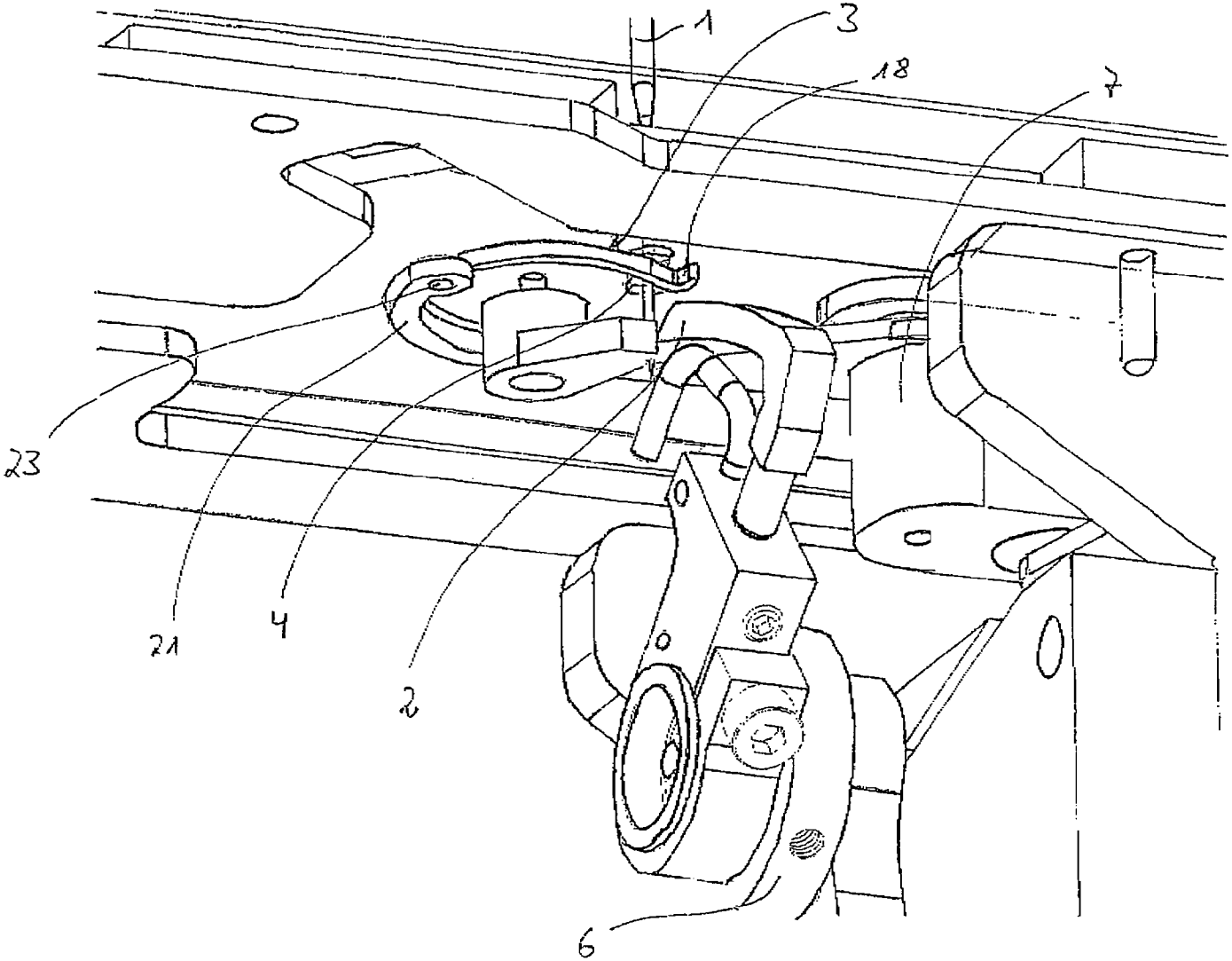
Figure 5:
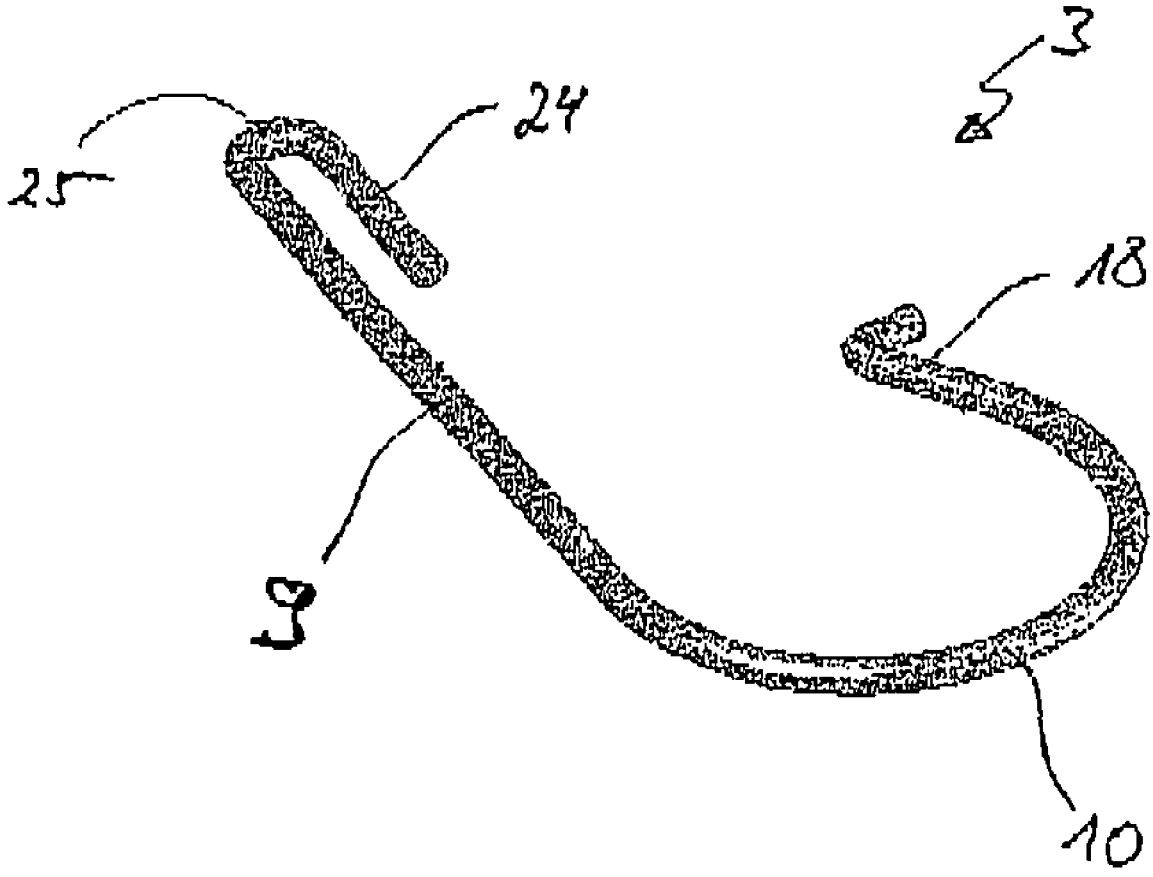

In the drawing it is shown by:

FIG. 1 a first embodiment of a detail of a sewing machine having three sewing elements;

FIG. 2 a second embodiment of a detail of a sewing machine having three sewing elements;

FIG. 3 a third embodiment of a detail of a sewing machine having three sewing elements;

FIG. 4 a fourth embodiment of a detail of a sewing machine having three sewing elements and FIG. 5 a spreader in a perspective view.

In FIG. 1 there are schematically illustrated three sewing elements, i.e. a needle 1, a looper 2 and a spreader 3 of a double chain stitch sewing machine not further shown. The needle 1 is moved up and down in an alternating fashion and passes through a stitch hole 4 of a fabric support 5. Below the fabric support 5 the looper 2 and the spreader 3 are arranged, and the looper 2 is moved in an oscillating fashion through a driving shaft 6 and a driving means (not further shown) connected thereto.

The spreader 3 is connected to a carrier 7 that is connected to an eccentric driving means 8, so that the spreader 3 moves on a substantially elliptical orbit on which the spreader 3 traverses or crosses the stitch hole 4 below the fabric support 5 one time.

The spreader 3 is L-shaped and comprises a longer leg 9 and a shorter leg 10 that includes on the free end thereof a protrusion 11 by which a thread triangle of a looper thread (not further shown) is spread such that the needle 1 carrying a needle thread (not further shown) is plunged in the thread triangle.

For this purpose a coordination of the movements of the three sewing elements 1, 2, 3 is required to prevent collisions of the needle 1 with the spreader 3 and the looper 2 respectively.

In the embodiment according to FIG. 1 the longer leg 9 of the spreader 3 includes a first plate-like element 12 provided with a bore 13 that is engaged by pin 14 of the carrier 7. The spreader 3 is mounted to the carrier 7 for pivoting about the pin 14. During a normal sewing operation the pivoting movement is prevented by a second pin 15 of the carrier 7, which pin 15 engages in a bore 16 of a second plate-like element 17 such that a force occurring in the case of a collision between the spreader 3 and the needle 1 pushes the spreader 3 over the pin 6, so that the pin 15 is disengaged from the bore 16 and thereafter the spreader 3 is connected to the carrier 7 merely through the pin 14. Being constructed in this way, the spreader 3 is able to dodge in the case of a collision with the needle 1, so that neither the needle 1 nor the spreader 3 will be damaged or destroyed.

Also provided and not further illustrated is a spring which in the case of a collision between the needle 1 and the spreader 3 is compressed by the pivoting movement of the spreader 3 with respect to the carrier 7, whereby subsequent to the collision the spreader 3 together with the needle 1 is withdrawn to its initial position in which the pin 15 engages again in the bore 16.

Alternatively or supplementary, a predetermined breaking point can be provided in the transition zone between the spreader 3 and the protrusion 11, which predetermined breaking point leads to that in the case of a collision the protrusion 11 will be separated from the spreader 3 in order to avoid damage to the needle 1. In this case the spreader 3 must be subsequently replaced. In the same way also the needle 1 can have a predetermined breaking point where the needle 1 will break off in the case of a collision.

A further embodiment of the invention is shown in FIG. 2 wherein parts and components which are identical with those of the embodiment shown in FIG. 1 carry identical reference numbers.

Differently from the embodiment according to FIG. 1 the embodiment according to FIG. 2 does not provide unlatching of the connection between the carrier 7 and the spreader 3, so that the spreader 3 remains rigidly connected to the carrier 7 through said two pins 14, 15.

Differently from the embodiment according to FIG. 1 the embodiment according to FIG. 2 shows a spreader 3 which is also L-shaped and which carries on the free end of the leg 10 an L-shaped spreading element 18 that extends almost parallel to the first leg 9 of the spreader 3 towards the carrier 7. The L-shaped spreading element 18 is formed with a square cross section and comprises a high elasticity which makes it possible for the spreading element 18 to be deflected towards the first leg 9 in the case of a collision with the needle 1. The elasticity of the spreading element 18 further allows that the spreading element 18 returns to its initial position after a collision with the needle 1.

On the spreading element 18 an inclined surface 19 is provided which is arranged in the region of a surface 20 facing the leg 9 and which is formed as a bevel.

This inclined surface 19 is provided for the event that the needle 1 should collide with the spreader 3. In this case of collision the needle 1 will be deflected through the inclined surface 19 to the area between the spreading element 18 and the leg 9.

A further embodiment is shown in FIG. 3, wherein identical parts and components again carry identical reference numbers. In the embodiment according to FIG. 3 the carrier 7 includes a U-shaped supporting arm 21 which is arranged below the leg 9 and the leg 10 of the spreader 3 and which supports the spreader 3 in these regions. In the embodiment according to FIG. 3 the free end of the spreader 3 is substantially semicircular arc-shaped. The legs 9 and 10 are formed with a square cross section, so that the spreader 3 has a high elasticity in the region of its legs 9, 10.

The supporting arm 21 includes in the region of its free end 22 a cylindrical protrusion 23 that serves as a support for the spreader 3. In the region of its part abutting the protrusion 23 the spreader 3 is formed such that it corresponds to the outer contour of the protrusion 23, with the leg 10 of the spreader 3 substantially abutting half of the outer shell surface of the protrusion 23. The spreader 3 is biased against the protrusion 23, so that in the case of a contact of the spreader 3 and especially of the spreading element 18 with the needle 1 the legs 9 and 10 of the spreader 3 will be deflected and that when the spreader 3 and especially the spreading element 18 and the needle 1 are out of contact again the spreader 3 will be returned to its initial position, i.e. to the position of the leg 10 abutting the protrusion 23, due to the biasing of the spreader 3 in the region of the legs 9 and 10.

FIG. 4 shows a further embodiment of the invention, of which the construction corresponds to the construction of the embodiment according to FIG. 3. Merely the shape of the supporting arm 21 is different from the embodiment according to FIG. 3.

FIG. 5 finally shows an alternative form of construction of a spreader 3 which consists of a wire having a circular cross section and made of a spring steel. The spreader 3 comprises a first leg 9 and a semicircular curved second leg 10 as well as an L-shaped spreading element 18. Moreover, on the free end of the leg 9 a short leg portion 24 extending parallel to the leg 9 is provided which is connected to the leg 9 through a semicircular arc 25. The leg portion 24 together with the arc 25 is also formed resiliently and it serves in particular for the spreader 3 being able to be inserted in a corresponding opening in the carrier 7.

The invention claimed is:

1. A chain stitch or a double chain stitch sewing machine, employing three stitch forming sewing elements, namely a needle, a looper, and a spreader, with said spreader spreading a thread triangle of a looper thread in which the needle carrying a needle thread plunges for the connection of the needle thread to the looper thread, and with the sewing elements being driven through at least one driving means, characterized in that the sewing elements are formed such that at least one sewing element, particularly the spreader, will dodge or break at a predetermined breaking point in the case of a collision with a second sewing element, particularly the needle, due to its design and/or it material properties.

2. The sewing machine according to claim 1, characterized in that the sewing elements are driven through separate driving means, which driving means are interconnected through an electronic control.

3. The sewing machine according to claim 1, characterized in that the spreader is guided on a closed orbit, in particular on a circular or an elliptical orbit.

4. The sewing machine according to claim 1, characterized in that the spreader is fixed in a carrier in such a way that the carrier will release the spreader upon reaching a predetermined force that occurs in the case of a collision with the needle and/or the looper.

5. The sewing machine according to claim 4, characterized in that the spreader is fixed in a two-point support in the carrier, with one supporting point opening or breaking when the predetermined force is reached, so that the spreader freely pivots about a second supporting point.

6. The sewing machine according to claim 4, characterized in that upon reaching the predetermined force the spreader pivots against a spring, which spring will push the spreader back to its initial position as soon as the spring force exceeds the predetermined force.

7. The sewing machine according to claim 1, characterized in that at least in the region of its free end spreading the thread triangle the spreader comprises an elasticity which makes it possible for the spreader to dodge at a contact with the needle.

8. The sewing machine according to claim 7, characterized in that the elasticity of the spreader is determined by its design and/or its material.

9. The sewing machine according to claim 7, characterized in that at least in the region of its free end the spreader is formed as a wire having a round or rectangular and especially a square cross section.

10. The sewing machine according to claim 7, characterized in that the region of its free end the spreader is supported on one side.

11. The sewing machine according to claim 4, characterized in that the spread is supported with respect to the carrier.

12. The sewing machine according to claim 1, characterized in that the spreader consists of a material with a high elastic modulus, particularly of spring steel or a plastic material.

13. The sewing machine according to claim 1, characterized in that the spreader comprises at least one inclined surface which is arranged in the region of the possible contact area with the needle and which is oriented to the needle.

14. The sewing machine according to claim 13, characterized in that the inclined surface is formed by a triangular cross section of the spreader in the possible contact area.

15. The sewing machine according to claim 1, characterized in that in a multiple needle sewing machine several spreaders are arranged on a supporting plate, and each of said spreaders comprises a predetermined breaking point.

16. A chain stitch or a double chain stitch sewing machine, consisting of a spreader that spreads a thread triangle of a looper thread in which the needle carrying a needle thread plunges for the connection of the needle thread to the looper thread, wherein in the case of a collision with a second sewing element, particularly with the needle (1), said spreader (3) will dodge or break at a predetermined breaking point, due to its design and/or its material properties.

17. The sewing machine according to claim 16, characterized in that the spreader is guided on a closed orbit, in particular on a circular or an elliptical orbit.

18. The sewing machine according to claim 16, characterized in that the spreader is fixed in a carrier in such a way that the carrier will release the spreader upon reaching a predetermined force that occurs in the case of a collision with the needle and/or the looper.

19. The sewing machine according to claim 18, characterized in that the spreader is fixed in a two-point support in the carrier, with one supporting point opening or breaking when the predetermined force is reached, so that the spreader freely pivots about a second supporting point.

20. The sewing machine according to claim 16, characterized in that upon reaching the predetermined force the spreader pivots against a spring, which spring will push the spreader back to its initial position as soon as the spring force exceeds the predetermined force.

21. The sewing machine according to claim 16, characterized in that at least in the region of its free end spreading the thread triangle the spreader comprises an elasticity which makes it possible for the spreader to dodge at a contact with the needle.

22. The sewing machine according to claim 21, characterized in that the elasticity of the spreader is determined by its design and/or its material.

23. The sewing machine according to claim 16, characterized in that at least in the region of its free end the spreader is formed as a wire having a round or rectangular and especially a square cross section.

24. The sewing machine according to claim 16, characterized in that the region of its free end the spreader is supported on one side.

25. The sewing machine according to claim 18, characterized in that the spread is supported with respect to the carrier.

26. The sewing machine according to claim 16, characterized in that the spreader consists of a material with a high elastic modulus, particularly of spring steel or a plastic material.

27. The sewing machine according to claim 16, characterized in that the spreader comprises at least one inclined surface which is arranged in the region of the possible contact area with the needle and which is oriented to the needle.

28. The sewing machine according to claim 27, characterized in that the inclined surface is formed by a triangular cross section of the spreader in the possible contact area.

29. The sewing machine according to claim 16, characterized in that in a multiple needle sewing machine several spreaders are arranged on a supporting plate, and each of said spreaders comprises a predetermined breaking point.

30. The sewing machine according to claim 1, wherein the machine is a multiple needle chain stitch or multiple needle double chain stitch sewing machine.

31. The sewing machine according to claim 16, wherein the machine is a multiple needle chain stitch or multiple needle double chain stitch sewing machine.

* * * * *

UNITED STATES PATENT AND TRADEMARK OFFICE

CERTIFICATE OF CORRECTION

PATENT NO. : 7,806,062 B2
APPLICATION NO. : 11/659984
DATED : October 5, 2010
INVENTOR(S) : Hartmut Klapp, Dirk Küster and Klaus Stutznäcker It is certified that error appears in the above-identified patent and that said Letters Patent is hereby corrected as shown below:

Column 6, Claim 1, line 10, the last three words, replace "it material properties" with --its material properties--;

Column 7, Claim 16, lines 2-3, the reference numerals should be deleted and the text should read: --element, particularly with the needle, said spreader--;

Column 8, Claim 25, line 9, replace "spread" with --spreader--.

Signed and Sealed this
Nineteenth Day of April, 2011

David J. Kappos

David J. Kappos
*Director of the United States Patent and Trademark Office*